United States Patent [19]

DiGiacomo et al.

[11] Patent Number: 4,960,358

[45] Date of Patent: Oct. 2, 1990

[54] BOTTOM-UNHEADING DEVICE AND METHOD FOR VERTICAL VESSELS

[75] Inventors: Frank A. DiGiacomo; Alan J. Malsbury, both of Parsippany; Ronald T. Myszka, Hopatcong, all of N.J.

[73] Assignee: Foster Wheeler USA Corporation, Clinton, N.J.

[21] Appl. No.: 390,423

[22] Filed: Aug. 4, 1989

Related U.S. Application Data

[63] Continuation of Ser. No. 148,587, Jan. 26, 1988, abandoned.

[51] Int. Cl.[5] ..... C10B 43/02

[52] U.S. Cl. ..... 414/684.3; 222/512; 222/526; 202/241; 414/589; 29/402.03; 29/402.06; 29/402.08

[58] Field of Search ..... 202/241, 248; 29/402.03, 402.06, 402.08; 414/684.3, 589, 590; 222/512, 526, 559, 560

[56] References Cited

U.S. PATENT DOCUMENTS

| | | | |
|---|---|---|---|
| 2,529,046 | 11/1950 | Padgett . | |
| 2,595,245 | 5/1952 | Grandinetti . | |
| 3,379,623 | 4/1968 | Forsyth . | |
| 3,480,186 | 11/1969 | Grosko | 222/512 |
| 3,765,579 | 10/1973 | Cramer et al. | 222/512 |
| 3,779,424 | 12/1973 | Shapland, Jr. | 222/512 X |
| 4,662,526 | 5/1987 | Schaller | 414/684.3 X |
| 4,726,109 | 2/1988 | Malsbury et al. | 29/402.8 |

FOREIGN PATENT DOCUMENTS 0265096 4/1988 European Pat. Off. .

*Primary Examiner*—Frank E. Werner
*Attorney, Agent, or Firm*—Marvin A. Naigur

[57] ABSTRACT

A bottom unheading device adapted for unheading vertical vessels such as coking drums. The unheading device includes a cover unit adapted for attachment to a lower flange of a coking drum and which is fastened by a plurality of swing bolts which are disconnected by remotely operated detensioning equipment, and a frame which can lower the cover unit and a carriage which moves it laterally to one side. A chute attached to the frame can be raised into engagement with the coking drum lower flange for removal of coke from the drum. Following such coke removal, the chute is lowered and the cover unit is moved laterally and remotely reconnected to the coking drum lower flange. The invention also discloses a method for remotely operating the unheading device.

7 Claims, 8 Drawing Sheets

BOTTOM-UNHEADING DEVICE AND METHOD FOR VERTICAL VESSELS

This application is a continuation, of application of Ser. No. 148,587, filed 1/26/88, now abandoned.

BACKGROUND OF INVENTION

This invention relates to a bottom unheading device for vertical vessels, such as coking drums which are adapted for remote operation. It particularly relates to such a bottom unheading device for removing and replacing a lower cover unit for coking drums and to a method for remote operation of the unheading device.

During the operation of delayed coking drums or vessels for coking various heavy hydrocarbon materials in petroleum refinery operations, the resulting coke is deposited progressively on the inner walls of the drum and when full must be removed, usually at 36–48 hour intervals. A typical decoking apparatus for such coking drums is disclosed by U.S. Pat. No. 4,611,613 to Kaplan. Such coke removal from coking drums is accomplished through an opening in the lower end of the vertically-oriented drum, and is usually accomplished by manually removing a lower flange cover and installing a chute to direct the coke removed to a desired location, such as to a hopper or rail car. Because the coking drum operates at relatively high temperatures of 800°–900° F., such removal of the hot coking drum lower cover by manual means is slow and hazardous and is therefore undesirable.

A useful remotely operated unheading device for coking drums is disclosed by U.S. Pat. No. 4,726,109 to Malsbury et al now U.S. Pat. No. 4,726,109. However, this prior unheading device has been found to have some basic deficiencies, which have been overcome by this invention. Accordingly, the invention advantageously provides an improved bottom unheading device for vertical vessels such as coking drums for remote safe and reliable removal and replacement of a coking drum lower cover unit, and enables more convenient and rapid removal of coke from the drum during decoking operations.

SUMMARY OF INVENTION

The present invention provides an improved unheading device for the bottom flange opening of vertically oriented vessels such as coking drums. The unbeading device is adapted for remote unfastening and removal of a lower cover unit from a lower flanged opening, moving the cover unit transversely to one side to permit coke removal from the vessel or drum, and subsequent replacement of the cover unit onto the coking drum. The unheading device according to the invention includes a cover unity adapted for being fastened pressure-tightly to a lower flange of a vessel or coking drum, bolt detensioning and pivotable clamping means adapted for unfastening a plurality of bolts for the cover unit and swinging the bolts radially outward and upward so as to permit downward removal of the cover unit, a vertically movable lifting frame means adapted for supporting and lowering the cover unit from the drum lower flange, and a carriage means partially supported by said lifting frame and adapted for lateral movement of the cover unit relative to the lifting frame and coking drum by dual horizontal piston actuator means arranged for moving the cover unit laterally to a side position. The unheading device also includes a chute attached to the lifting frame, so that after the cover unit is moved aside the chute can be raised to contact the coking drum lower flange for conveying the coke removed from the drum. The unheading device also provides means for the cover unit to be returned laterally so as to be below and in vertical alignment with the coking vessel lower flange, then lifted up into engagement with the lower flange, after which the cover unit fasteners can be rotated downwardly and refastened to reclamp the cover unit into place on the coking drum lower flange.

The multiple bolt fasteners of the unheading device are pivotally attached to the coking vessel lower flange, so that they can be swung radially outward and upward by vertically-oriented piston actuators attached to the vessel, thus permitting lowering of the cover unit. Preferably, the multiple bolt fasteners are substantially equally spaced and two adjacent pivotable bolts are attached to a single piston actuator. The lifting frame means is rectangular-shaped and is supported and moved vertically by four equally-spaced hydraulic piston actuators, which are attached at their lower ends to the frame outer corners and are attached at their upper ends to the coking vessel.

A chute is attached to the lifting frame means for use in removing the deposited coke from the vessel. After the cover unit mating flanges are unfastened, the frame means can lower the cover unit by operation of the four vertically-oriented piston actuators, after which the cover unit can be moved laterally from beneath the coker drum by carriage means including dual horizontal piston actuators located along opposite sides of the cover unit. The lifting frame means four piston actuators then raise the coke chute into contact with the coking drum lower flange into the decoking position, so that the accumulated coke can be removed from the vessel through the chute.

After decoking of the vessel is completed, the four piston actuators then lower the lifting frame means and the attached coke chute, after which the cover unit is then moved laterally back to a position directly below the drum lower flange by action of the dual horizontal piston actuators. The frame means then raises the cover unit mating position for rebolting it to the coking drum lower flange. The bolt detensioning and lift mechanisms for the cover unit and coke chute are advantageously operated by hydraulic pistons operated by remote control. This unheading device and chute arrangement can be advantageously applied to either new or existing delayed coking drums, for decoking the drums much more rapidly and with increased reliability and safety at intervals of 36–48 hours operation.

The present invention also provides a method for removing a lower cover unit from vertically oriented vessels such as coking drums for coke removal, and replacing the cover unit on the vessel or coking drum. The method includes the steps of unfastening a flanged joint provided between a lower flanged opening of the delayed coking vessel and a removable cover unit by detensioning a plurality of bolt fasteners using remotely operated hydraulic devices for detensioning the fastener bolts, and swinging the bolts radially outwardly and upwardly, then lowering the cover unit and moving it laterally to a side position. Next, a coke chute is raised and connected to the coking vessel lower flange for removing the coke contents from the vessel. Following such coke removal, the chute is lowered and the cover unit is moved laterally so as to be in vertical alignment with the coking vessel lower flange, and then raised back into its original position against the coking vessel flange. The fastener bolts are then swung downwardly into position and retensioned to reconnect the cover unit onto the coking vessel lower flange.

It is an advantage to have a vessel or a coking drum lower cover unit that can be conveniently and safely removed from the coking drum using a remotely-operated unheading device, which loosens the plurality of bolt fasteners and pivots the fasteners outwardly, then lowers the cover unit and moves it laterally aside. Such unheading device and method permits more rapid and reliable removal of coke deposited in a coking drum, so as to increase the available operating time for the drum, and also improves personal safety by avoiding undesirable exposure of personnel to hot hydrocarbons, steam and water during such unheading operations. Vertically oriented vessels on which this unheading device and method can be advantageously used include coking drums, reactors, or any vessel of a similar configuration, where danger to personnel exits during an unheading operation.

BRIEF DESCRIPTION OF DRAWINGS

This invention will be further described with reference to the following drawings, in which.

DETAILED DESCRIPTION OF INVENTION

Figure 1:
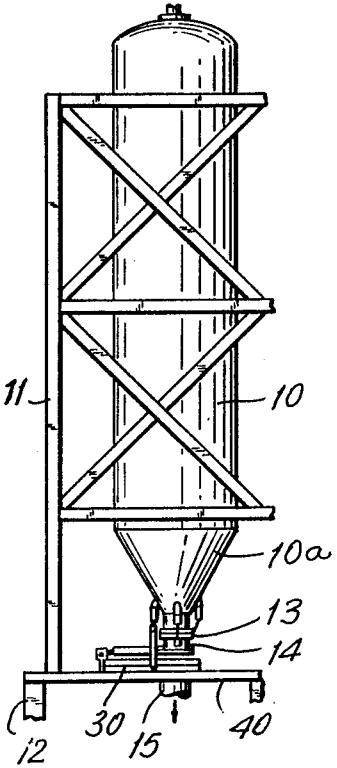
FIG. 1 shows a vertically-oriented delayed coking vessel or drum having a structural support means and a removable lower cover unit provided at the drum lower end.

As generally shown by the FIG. 1 drawing, a delayed coking drum or vessel 10 is vertically-oriented and supported by an adjacent support structure 11 and also by a lower platform structure 12 provided below the drum 10. Such a delayed coking drum 10 for use in petroleum refineries is usually 20–25 ft. diameter and 75–100 ft. tall, and has a conical lower portion 10*a* attached to a lower flange 13 which is usually 5–7 ft. diameter. A removable lower cover unit 14 is pressure-tightly attached to the lower flange 13 by a plurality of clamp fastener means 20. The coke deposited progressively in coking drum vessel 10 is removed from the drum periodically as needed by removing the lower cover unit 14 and hydraulically cutting the coke from within the vessel, so that the coke falls through a chute 15 into a storage pit or a rail car (not shown) for further use.

Figure 2:
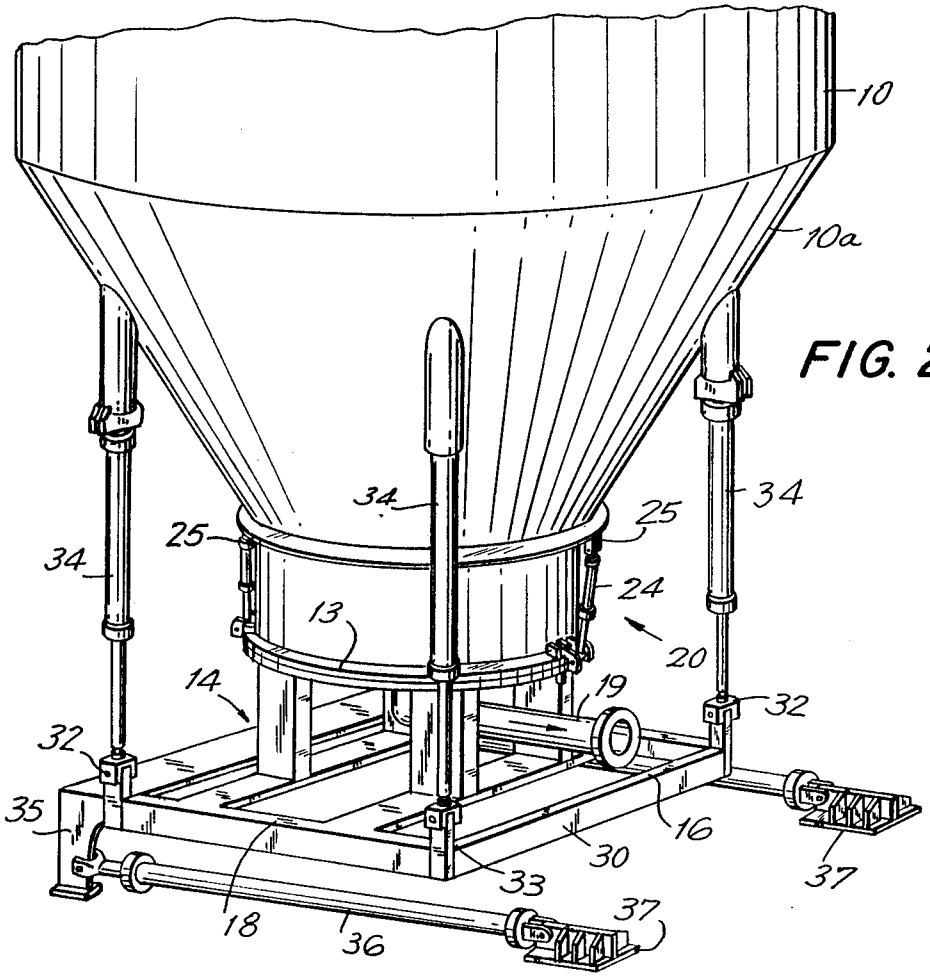
FIG. 2 shows an enlarged perspective view of the bottom unheader device removably attached to the coking drum lower flange and supported by a vertically movable frame member according to the present invention, with the cover unit and it fastening bolts connected in place.
Figure 3:
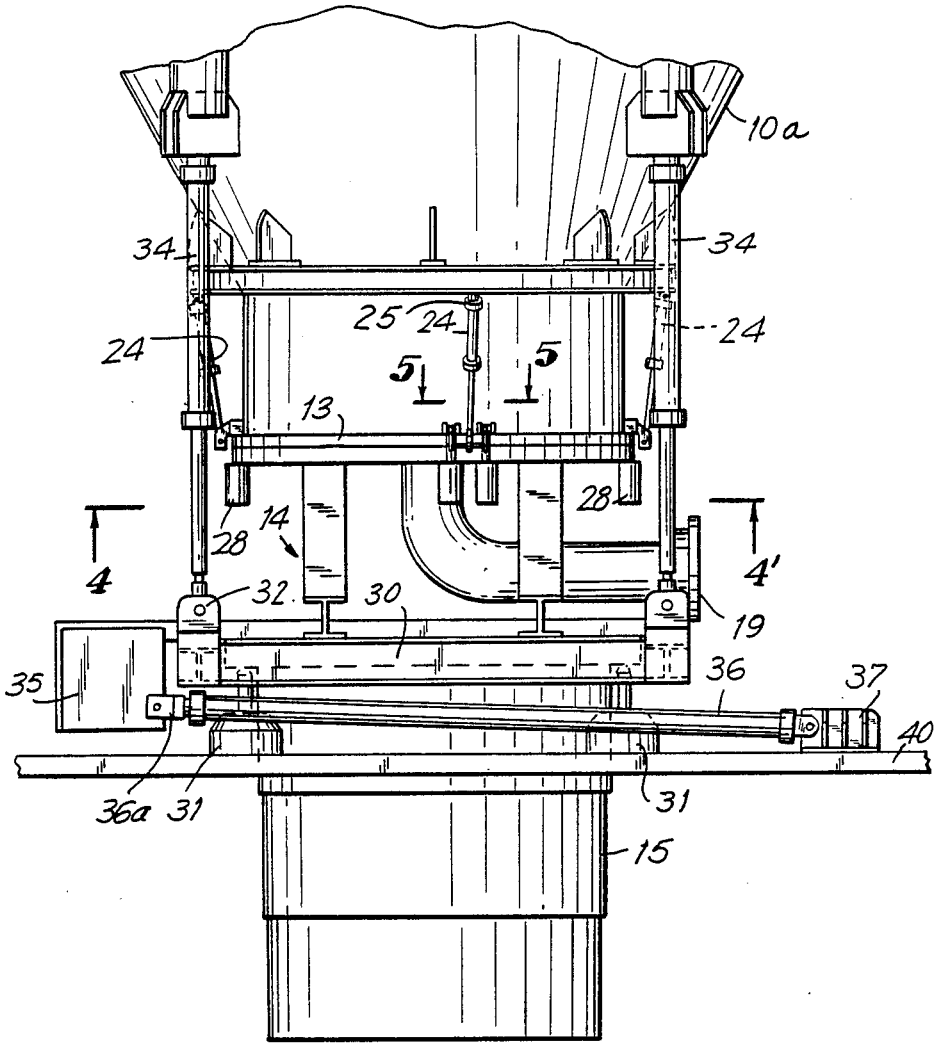
FIG. 3 is an enlarged elevation view showing the cover unit removably attached to the coking vessel lower flange, and the supporting frame member and a coke removal chute provided below the cover unit.
Figure 4:
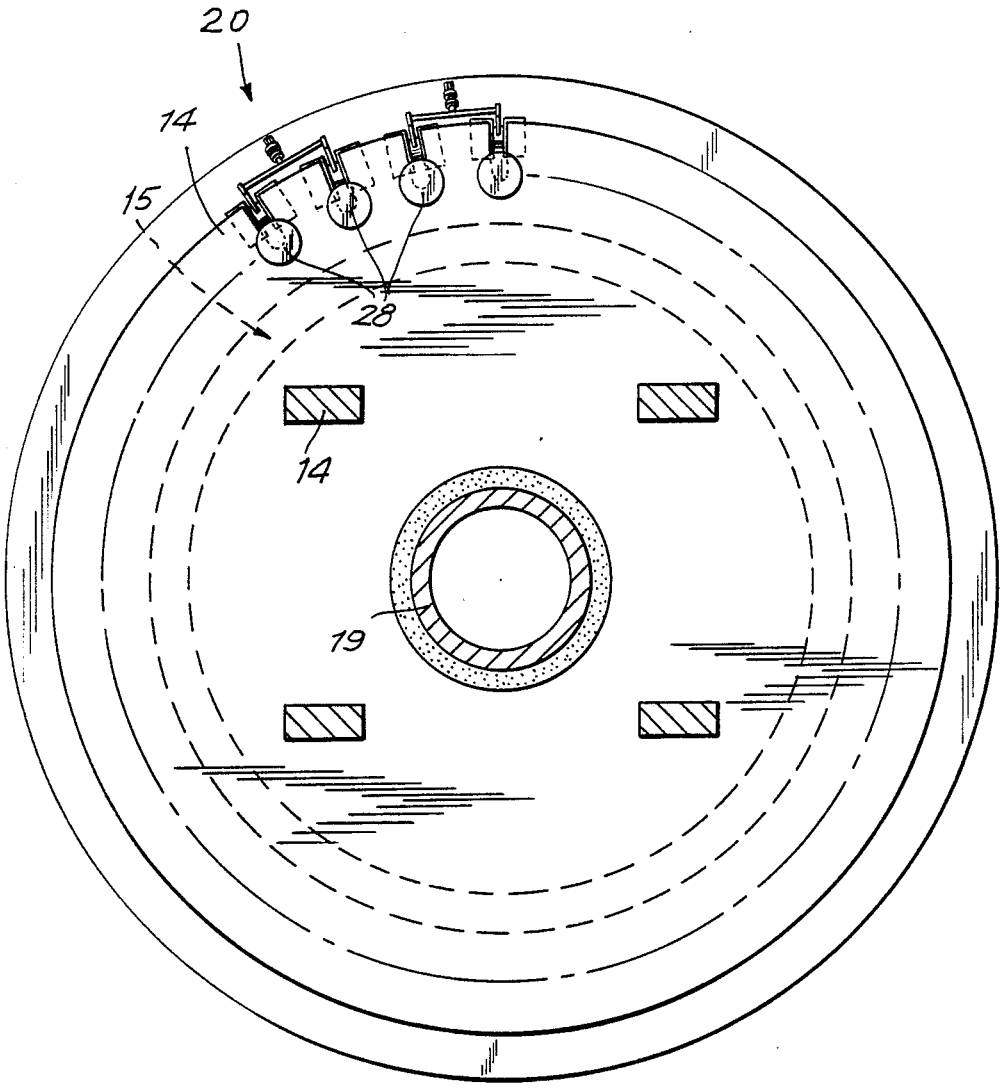
FIG. 4 is an enlarged cross-sectional plan view taken at line 4—4' of FIG. 3, showing location of detensioning and actuator means for removing the multiple fasteners in the coking drum lower flange.

The cover unit 14 is fastened onto the lower flange 13 of vessel 10 by multiple pivotable clamp fastener means 20, as shown in greater detail by FIGS. 2 and 3. Cover unit 14 includes a cradle support structure 16 having dual horizontal skid members 18 extending along two opposite sides of the cradle, structure 16 and which are supported partially by a rectangular-shaped frame member or unit 30. It will be noted that cover unit 14 also includes a lateral conduit 19 used for feeding hydrocarbon, steam and water materials into the coke drum 10 and to drain water from the drum. As is shown in FIGS. 2 and 3 and further shown in FIG. 4, 16–48 swing type clamp fasteners 20 (depending on the flange diameter and pressure rating) are provided evenly spaced around the periphery of flange 13 for pressure-tightly clamping the cover unit 14 onto the lower flange 13 of vessel 10.

Figure 5:
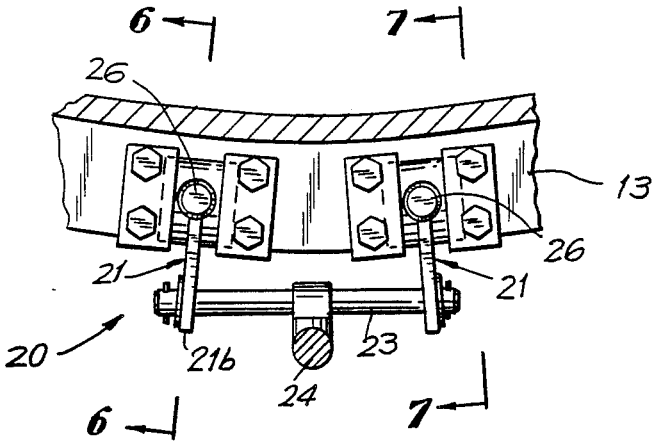
FIG. 5 shows a detail plan view of a flange clamp taken at line 5—5' of FIG. 3.
Figure 6:
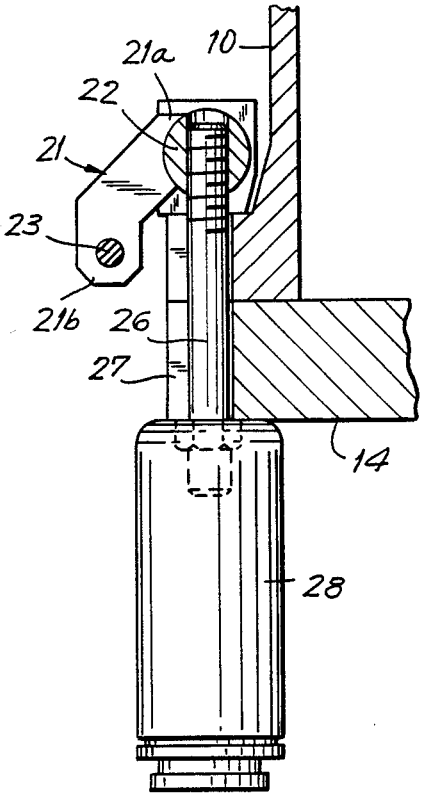
FIGS. 6 and 7 show sectional elevation views taken at lines 6—6' and 7—7' of FIG. 5.
Figure 7:
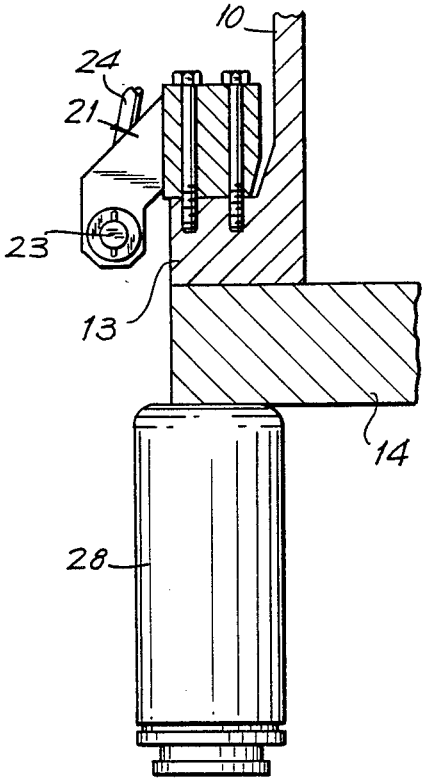

As shown in greater detail by FIGS. 5–7, each clamp fastener means 20 is constructed and operated similarly, and includes a clamp arm 21 which is pivotably attached at its upper end 21*a* to flange 13 by a pivot pin 22 pivotably secured to the upper surface of flange 13 near the outer perimeter of the flange. The other or lower end 21*b* of clamp arm 21 is pivotally attached to a lower end of a piston actuator 24. The upper end of actuator 24 is pivotably attached at 25 to the outer wall portion 10*a* of coker drum 10 as shown by FIGS. 2 and 3. The upper end 21*a* of each clamp 21 is also rigidly connected via pivot pin 22 to the upper end of a fastener bolt 26, which is provided in a vertical slot 27 provided in both the lower flange 13 of vessel 10 and in the mating cover unit 14. Also, a remotely operated tensioning unit 28 is provided attached to each bolt 26 below the cover unit 14, as shown in FIG. 3. The bolt tensioning unit 28 may be similar to that described in U.S. Pat. No. 3,015,975 to Biach, which is incorporated herein by reference to the extent necessary to adequately disclose the present invention. The tensioning units 28 are usually operated by a suitable hydraulic pressure source connected to each tensioning unit. Preferably, each two adjacent pivotable bolts 26 are attached to a single piston actuator 24 attached to an elongated pivot pin 23, as shown by FIG. 5.

When it is desired to open the flanged joint between the drum lower flange 13 and cover unit 14, the bolt tensioning units 28 are first remotely actuated to detension the bolts 26, thereby lowering the cover unit 14 and its cradle structure 16 by a distance of 0.25–1 inch by the lift frame support unit 30. Then, the swing actuator pistons 24 are actuated, so as to swing the bolts 26 radially outwardly and upwardly to a disconnected or unfastened position as shown in FIG. 8.

Figure 8:
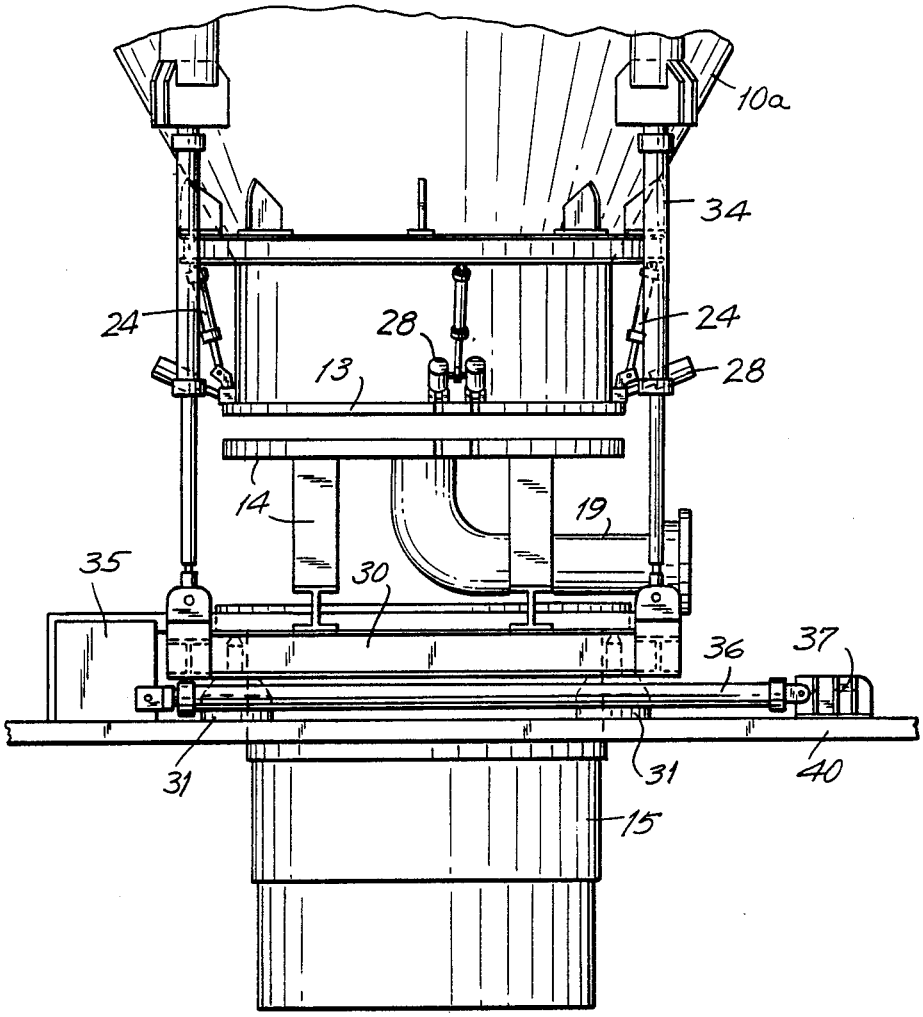
FIG. 8 shows an enlarged elevation view similar to FIG. 3, but with the flange fastener bolts swung outwardly and the cover unit lowered away from the coking drum lower flange.
Figure 9:
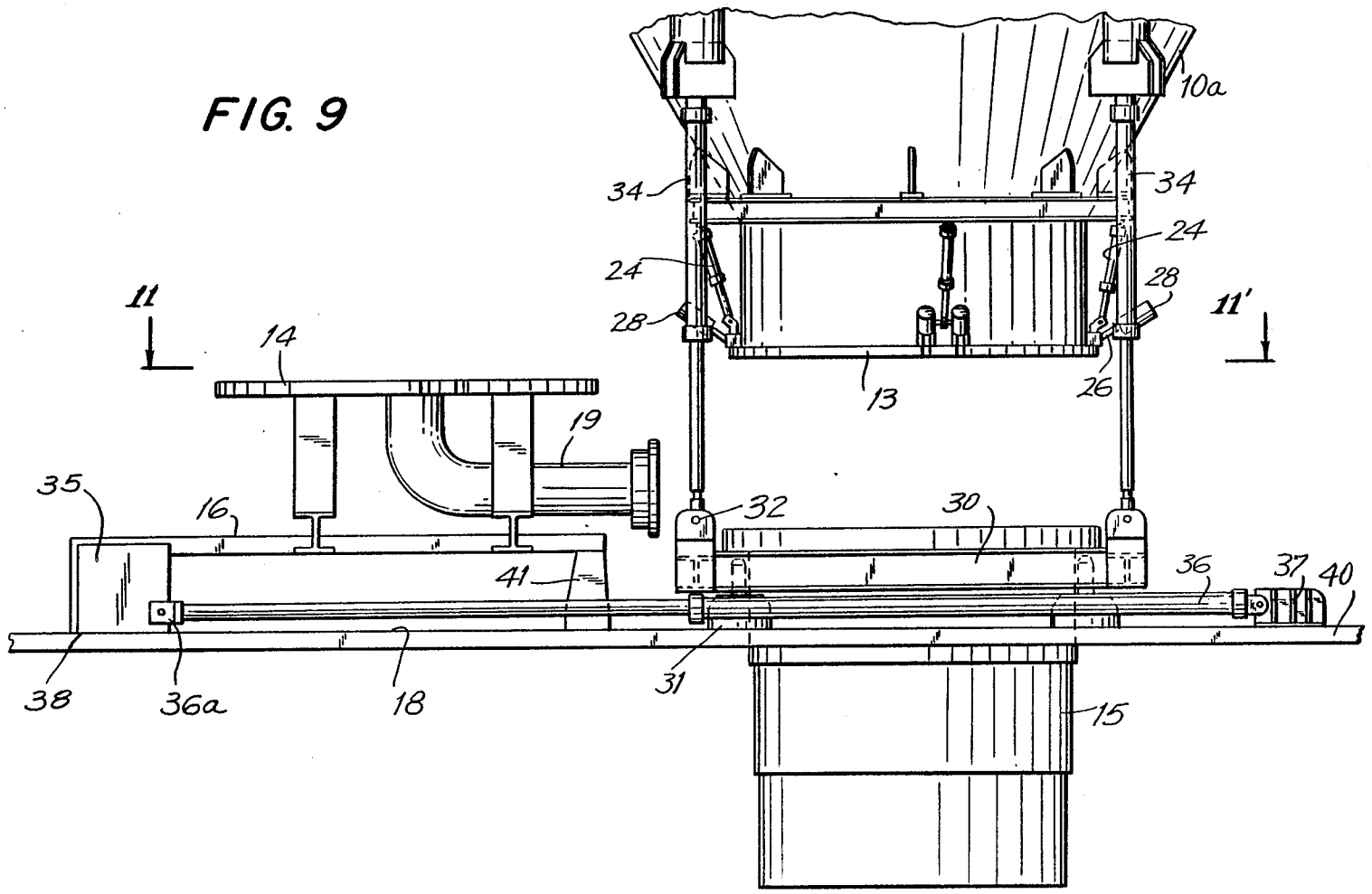
FIG. 9 is an elevation view showing, the frame member lowered onto location pins and the cover and cradle units moved aside.
Figure 10:
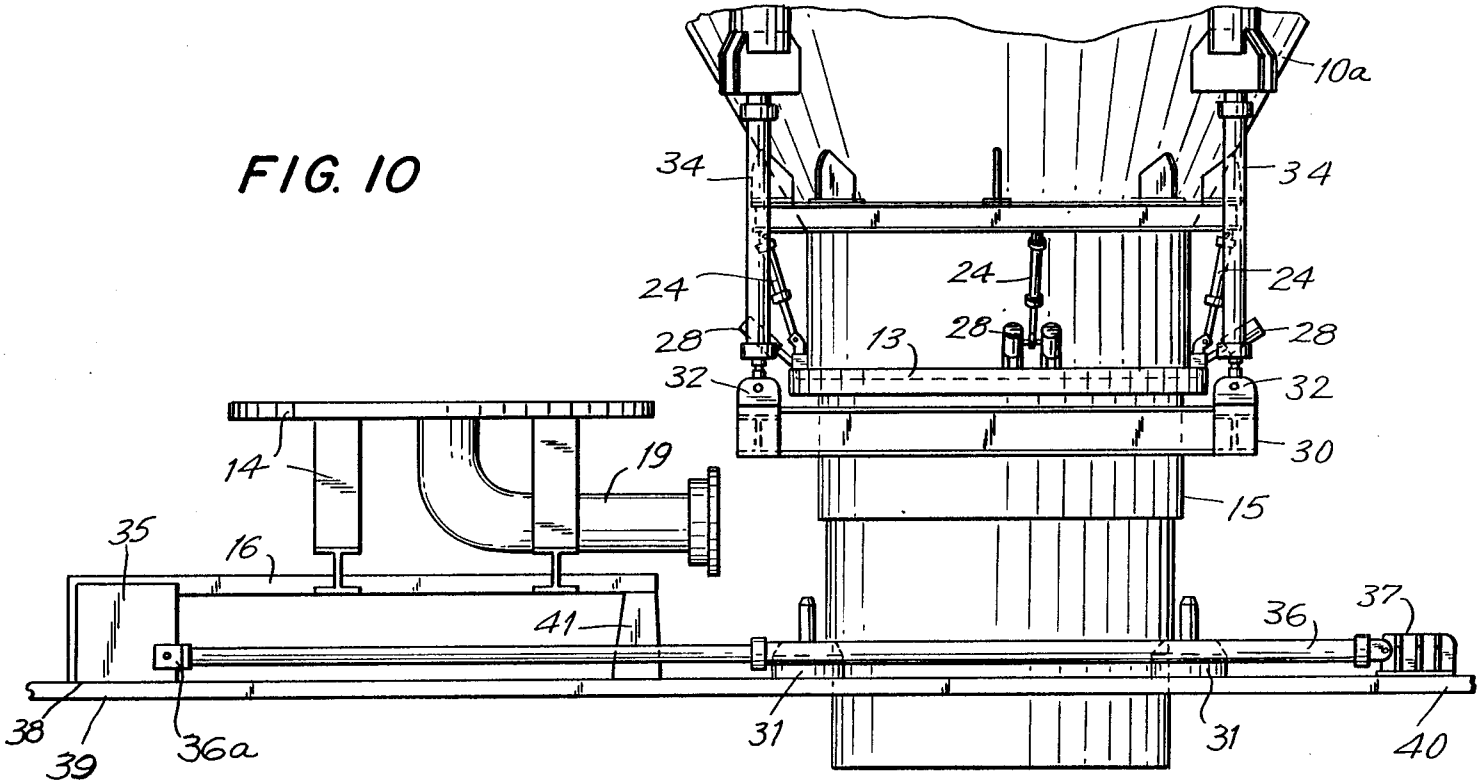
FIG. 10 is an elevation view similar to FIG. 9, showing the cover unit moved aside and the lifting frame member and coke chute moved upwardly, to contact the coking drum lower flange for removal of coke from the drum.

For supporting and lowering the cover unit 14 from the coker vessel lower flange 13, the lift frame support unit 30 is provided below and in supporting engagement with dual skid members 18 of cradle structure 16, as is shown by FIGS. 2, 3 and 8. The frame unit 30 is adapted for contacting the lower surface of cradle support structure 16 and skid member 18 of the cover unit 14. The frame unit 30 includes four vertically-extending brackets 32 located at its four corners, and each bracket is pivotally attached to a vertically-oriented piston actuator 34 adapted for controllably lifting and lowering the frame unit 30. The upper end of each piston actuator 34 is pivotably attached to the conical portion 10*a* of coking drum 10. After the fastener bolts 26 have been detensioned and the cover unit 14 initially lowered by 0.25–1 inch and is being supported by frame unit 30, the bolts 26 are then swung radially outwardly and upwardly from flange 13. Then the cover unit 14 is further lowered by frame unit 30 as shown by FIG. 8, and is then moved laterally aside by carriage means as shown by FIGS. 9 and 10. The vertical movements for cover unit 14 are accomplished by it being vertically movable by the four vertically-oriented piston actuators 34. The frame unit 30 is lowered onto at least two and usually four alignment pins 31, as shown in FIG. 3, so that the frame 30 remains in a fixed horizontal position relative to the flange 13 of cooking drum 10.

Figure 11:
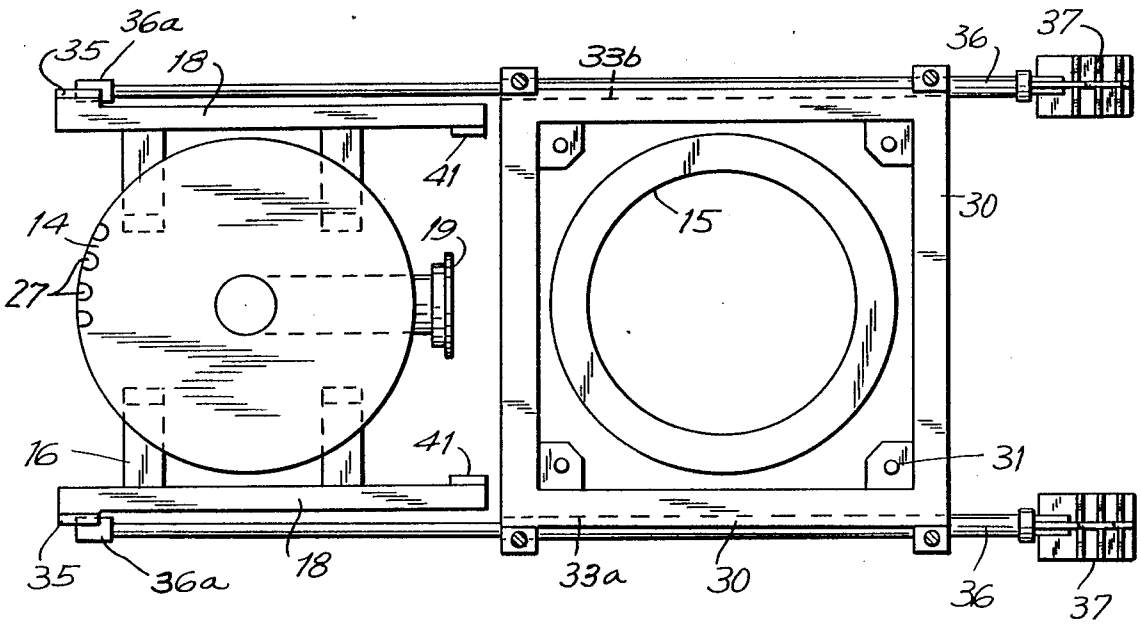
FIG. 11 shows a plan view of the unheader device taken at line 11—11' of FIG. 9.

After the cover unit 14 has been lowered by action of frame unit 30, and vertical piston actuators 34 as shown by FIG. 8, the cover unit 14 is then moved aside laterally by carriage means including dual horizontal piston actuators 36, which extend substantially horizontally along two sides of cover unit 14. The dual actuators of carriage means 36 are each connected at their forward end 36*a* to cover unit 14 by lug 35, and are each connected at their rearward end to anchor means 37. The orientation and relative position of the parts of lifting frame unit 30 is additionally shown in a plan view of platform support device by FIG. 11.

While the cover unit 14 is being moved aside laterally to an offset position as shown by FIGS. 9 and 10, by extension action of the piston actuators 36, the lower skid members 18 are initially retained by dual guide surfaces 33*a* and 33*b* which are provided extending along opposite sides of the frame unit 30. The forward end portion of cradle support 16 is preferably partially supported by dual support means 38, such as rollers or slide plates running along parallel tracks 39 provided in deck 40. The rear end of cradle support 16 rests on a chair member 41 attached to deck 40. Then, after the cover unit 14 has been moved laterally to one side and thereby is detached from the lifting frame 30, collapsible chute 15 which is attached to lower portion 30*a* of the frame device 30, is simultaneously raised by action of the four piston actuators 34 so that chute 15 contacts the lower flange 13 of the coker vessel 10. An elevation view of the chute 15 being in contact with the lower flange 13 of the coker vessel 10 is shown by FIG. 10. The coke is removed from within the coking drum 10 and falls through chute 15 to a storage pit or rail car (not shown) for further processing or use.

After the decoking operation for the coker drum 10 is completed, the frame unit 30 and attached chute 15 are lowered, and then cover unit 14 is returned by carriage means 36 to its original position then raised and reconnected onto the drum flange 13, as was shown by FIGS. 2 and 3. This return movement for cover unit 14 is accomplished by first lowering frame 30 and coke chute 15 by the four actuator pistons 34, then retracting dual piston actuators 36 to move the cover unit 14 laterally to a position in vertical alignment below flange 13, then raising frame 30 so that cover unit 14 is again placed against and in alignment with lower flange 13. Next, the swing actuators 24 are extended so as to pivot the bolts 26 downwardly into the slots 27, as shown by FIGS. 6 and 7. Then the multiple tensioning units 28 are actually so as to clamp the mating flange 13 and cover unit 14 tightly together again.

This invention will be further described by the following example of operations, which should not be construed as limiting the scope of the invention.

EXAMPLE

In a coking drum used for delayed coking of petroleum feedstocks, after 36–48 hours of operation sufficient coke is deposited progressively on the inner wall of the drum that removal of the coke is required before continued operation. The coking drum, which is equipped with a lower flange cover unit constructed and operated in accordance with this invention, is shut down, depressurized and the lower head cover unit is removed. Important characteristics of the coker drum lower cover unit and unheading device are as follows:

| | |
|---|---|
| Coker lower flange diameter, in | 72 |
| Cover unit flange diameter, in. | 72 |
| Cover unit length, in. | 18 |
| Number of fastener swing bolts | 36 |
| Swing bolt diameter, in. | 1.25 |
| Bolt slot width in flange, in. | 1.5 |
| Vertical movement of lift frame, in. | 12 |
| Lateral movement of cover unit, in. | 105 |
| Lift actuator hydraulic pressure, psig | 1500 |

Following switch out of the heavy hydrocarbon feed, steam, water quench and draining of the coking drum, the lower cover unit is removed and replaced using the following procedure:

(a) Detention the fastener swing bolts clamping the cover unit to the coking drum lower flange by pressurizing the hydraulically-operated bolt tension units to sufficiently loosen the bolts to lower the cover unit 0.25–1 inch onto a lifting frame unit and thereby permit the bolts to be swung outwardly from the flange periphery.

(b) Pressurize the swing, the piston actuators to retract and swing fastener bolts outwardly and upwardly, thus freeing the cover unit flange from the coking drum lever flange.

(c) Pressurize the lift frame actuators and lower the cover unit, then move it aside by pressurizing and extending the dual lateral piston actuators.

(d) Reverse pressurize four lift actuators to move coke chute upwardly to mate with the coking drum lower flange to permit removal of the coke.

(e) Following removal of accumulated coke from the coking drum, lower the coke chute, move the cover unit laterally to be back in vertical alignment with the coking drum flange, and then lift the cover unit to mate with the coking drum flange.

(f) Reverse pressurize swing piston actuators to extend the swing a bolts downward into the bolt slots of the cover flange, then actuate the tensioning units to retension the flange bolts to securely reclamp the cover unit onto the lower flange of the coking drum.

Although this invention has been disclosed broadly and in terms of a preferred embodiment, it will be understood that modifications and variations can be made within the scope of the invention, which is defined by the following claims.

We claim:

1. An improved unheading device adapted for removal and replacement of a lower cover unit for a vertical vessel, comprising:

(a) a cover unit adapted for being sealably attached by bolts to a lower flange of a lower flanged opening in a vertical vessel, said cover unit including a supporting cradle means;

(b) at least eight pivotable clamping means each including a detensioning means said clamping means being substantially equally spaced around the perimeter of said cover unit and adapted for detensioning and pivotably removing the bolts located in said cover unit and the lower flange of the vessel so as to unfasten said cover unit from the vessel;

(c) a lifting frame means located below said cover unit and said cradle means, said lifting frame being supported from said vessel and vertically movable by four equally-spaced vertically-oriented piston actuator means; and (d) carriage means adapted for providing lateral movement of the cover unit relative to the lifting frame means by dual horizontal piston actuator means, said carriage means being at least partly supported by said lifting frame during lateral movement of the cover unit, whereby the cover unit can be lowered from the vessel lower flange and moved aside laterally to permit material removal through the lower opening in the vessel, and then reconnected to the vessel lower flange.

2. The unheading device of claim 1, wherein each clamping means is pivotally attached to said vessel lower flange and multiple sets of two adjacent clamping means which are attached to s single hydraulic piston actuator, whereby the clamping means bolts can be swung radially outwardly and upwardly to unfasten the flanged joint from the vessel.

3. The unheading device of claim 1, wherein said lifting frame when lowered is retained in a horizontal position directly below said lower flange by a plurality of vertically-oriented pegs which interfit with openings in the frame.

4. The unheading device of claim 1, wherein said cradle means is at least partially supported by slide plates located at the cradle means forward end.

5. The unheading device of claim 4, wherein said cradle means slide plates slide on dual rails located below a deck surface.

6. The unheading device of claim 1, including a chute attached to said lifting frame means and adapted for contact with the vessel lower head flange for removing material from the vessel.

7. An improved unheading device adapted for removal and replacement of a lower cover unit for flanged openings in a vertically oriented coking drum, comprising:

(a) a cover unit adapted for being sealably attached by bolts to a flange of a lower flanged opening in a coking drum, said cover unit being attached to a supporting cradle means;

(b) at least eight pivotable clamping means each pivotably attached to the vessel lower flange and including a detensioning means, said clamping means being substantially equally spaced around the perimeter of said cover unit, each detensioning means being adapted for connecting onto a lower nut for detensioning and removing the fastening bolts pivotably outward and upward so as to unfasten said cover unit from the coking drum lower flange;

(c) a lifting frame means located below said cover unit and said cradle means, said lifting frame being supported from said coking drum and vertically movable by four equally-spaced vertically-oriented piston actuator means; and (d) carriage means supported partially by said lifting frame, said carriage means being adapted for lateral movement relative to the lifting frame by dual horizontally oriented piston actuators which are each attached to the carriage means forward end, said carriage means being supported at its forward end by a guide surface sliding on a support rail, whereby said cover unit can be lowered from the coking drum lower flange and moved laterally aside to permit coke removal through the lower opening in the coking drum, and then reconnected to the coking drum lower flange.

* * * * *